US005345861A

United States Patent [19]

Brewer et al.

[11] Patent Number: 5,345,861

[45] Date of Patent: Sep. 13, 1994

[54] PRESS ADJUSTMENT SCREW MECHANISM

[75] Inventors: William C. Brewer, Minster; Edward A. Daniel, Fort Loramie; Frederick C. Bergman, Coldwater, all of Ohio

[73] Assignee: The Minater Machine Company, Minster, Ohio

[21] Appl. No.: 49,992

[22] Filed: Apr. 20, 1993

[51] Int. Cl.[5] ..... B30B 5/00

[52] U.S. Cl. ..... 100/257; 72/448; 72/455; 83/527; 100/53

[58] Field of Search ..... 100/43, 48, 53, 257, 100/299; 72/21, 446, 448, 455; 83/527, 530

[56] References Cited

U.S. PATENT DOCUMENTS

| | | | |
|---|---|---|---|
| 3,178,983 | 4/1965 | Brunson | 83/530 |
| 3,858,432 | 1/1975 | Voorhees et al. | 72/446 X |
| 3,892,143 | 7/1975 | Kleister et al. | 100/53 X |
| 4,011,809 | 3/1977 | Waller et al. | 100/53 X |
| 4,030,336 | 6/1977 | Grigorenko et al. | 72/432 |
| 4,095,522 | 6/1978 | Drungil | 100/257 X |
| 4,096,728 | 6/1978 | Glecker et al. | 100/257 X |
| 4,150,618 | 4/1979 | Spanke et al. | 100/257 |
| 4,160,409 | 7/1979 | Portmann | 100/257 X |
| 4,166,415 | 9/1979 | Spanke et al. | 100/53 |
| 4,206,699 | 6/1980 | Hemmelgarn | 100/53 |
| 4,206,701 | 6/1980 | Hemmelgarn | 100/257 |
| 4,289,066 | 9/1981 | Proga | 100/257 X |
| 4,464,916 | 8/1984 | Grew et al. | 72/17 |
| 4,677,908 | 7/1987 | Imnanishi et al. | 100/53 |
| 4,785,732 | 11/1988 | Czapka et al. | 100/257 |
| 4,790,173 | 12/1988 | Boutcher, Jr. | 72/446 |
| 4,823,687 | 4/1989 | Yonezawa et al. | 100/53 |
| 4,918,956 | 4/1990 | Schoch | 72/21 |

FOREIGN PATENT DOCUMENTS

| | | | |
|---|---|---|---|
| 272437 | 10/1989 | Fed. Rep. of Germany | 100/299 |
| 948808 | 8/1949 | France | 100/257 |

*Primary Examiner*—Stephen F. Gerrity
*Attorney, Agent, or Firm*—Baker & Daniels

[57] ABSTRACT

A shutheight adjustment mechanism for a mechanical press including an adjustment screw rotatable to vary shutheight. A pressurized chamber is formed between the adjustment screw and the housing of the adjustment mechanism. Fluid is injected into the chamber to create an oil squeeze-film capable of supporting high impulse working loads and also preload the adjustment screw in the direction of press closure. A rebound damping mechanism is included having a two part takeup nut assembly. Upon actuation of the takeup nut assembly, the two part takeup nut assembly separates to bear on opposite facing thread surfaces of the adjustment screw thereby reducing clearance space and possible changes in shutheight.

18 Claims, 5 Drawing Sheets

PRESS ADJUSTMENT SCREW MECHANISM

BACKGROUND OF THE INVENTION

The present invention relates generally to mechanical presses and in particular to a shutheight adjustment mechanism, wherein punching and snapthrough loads through the shutheight adjustment mechanism are more accurately controlled.

Mechanical presses, for example, stamping presses and drawing presses, comprise a frame having a crown and bed and a slide supported within the frame for motion toward and away from the bed. The slide is driven by a crankshaft having a connecting arm connected to the slide. Such mechanical presses are widely used for stamping and drawing operations and vary substantially in size and available tonnage depending upon the intended use.

In prior art presses of this type, the slide is generally connected to the crankshaft by a connecting rod which is adjustable in length or which is connected to another member, such as a connection screw that is adjustable in its relation to the slide so that the shutheight opening between the slide and the bed can be adjusted to accommodate various die sets. Alternatively, the bed portion or bolster of the press may have its position adjusted relative to the slide so as to adjust the shutheight therebetween, as disclosed in U.S. Pat. No. 3,858,432. Regardless of the mode of shutheight adjustment, the slide is generally guided on the uprights of the press frame extending between the crown and the bed so that the parts of the die set remain in accurate registration as the slide reciprocates.

Many prior art mechanical presses include a plurality of adjustment screw assemblies within a shutheight adjustment mechanism attached to the bolster, whereby the position of the bolster is adjusted simultaneously by each of the adjustment screws. Bolster position may be changed by means of an interconnected worm and worm gear arrangement rotating the adjustment screws. The worm and worm gear are driven either manually or by means of a motor.

Prior problems with shutheight adjustment mechanisms include the transfer of punching and rebound loads through the adjustment mechanisms and adjustment screws during press operation. A press load is the load created by the mechanical press when the slide is urging its associated die into contact with the work piece. When the work piece fractures in the die, the slide attempts to rapidly accelerate downward, i.e. snapthrough. This snapthrough load is comprised mainly of this downward acceleration and the downward slider crank inertial acceleration of the die and slide combination. At the same time, the bolster accelerates in an upward direction, i.e. rebound. These loads, if not compensated for, cause changes in shutheight during press operation.

A particular problem for accurately controlling press shutheight is the tolerances between the connected portions of the press, and specifically the connections of the shutheight adjustment mechanism to the bolster. Shutheight adjustment mechanisms require certain clearances between the parts during manufacture, assembly, and adjustment so that the worm gear, adjustment nuts, and connection screws may turn and operate. These same clearances between the parts cause a problem during press use, since the clearances increase the possible ranges of shutheight.

The clearances within the shutheight adjustment mechanism also prevent the even transmission of pressure loads through the press. This uneven transmission of forces may cause particular parts, undergoing concentrated impact forces, to fail. Again, the clearances between the parts permit the shutheight to variably change during operation of the press, resulting in workpieces that may not meet design specifications.

The present invention is directed to overcome the aforementioned problems associated with mechanical press shutheight adjustment mechanisms wherein it is desired to accurately control shutheight while increasing protection of the shutheight adjustment mechanism by preloading and stabilizing the shutheight adjustment screw.

SUMMARY OF THE INVENTION

The present invention provides a shutheight adjustment mechanism including an assembly for both preloading and damping rebound of the adjustment screw used to change shutheight. The shutheight mechanism of the present invention is arranged for adjustment in motion and includes a housing having an adjustment screw to vary the shutheight of the press. A preload mechanism includes a pressurized fluid chamber in which oil is trapped between the housing and adjustment screw to preload the adjustment screw toward the press closure. The trapped oil supports the created loads on a pressure film (a "squeeze-film"), thereby reducing part movement and the chance of impact between parts. A two-part lock nut assembly is utilized to reduce rebound by removing the clearance space between the adjustment screw and the adjustment nut assembly. A sealable chamber within the two-part lock nut assembly is pressurized with a fluid so that the two parts of the assembly are forced apart and into contact with opposite facing thread surfaces of the adjustment screw.

The shutheight adjustment mechanism is permitted to operate while the press is cycling. This is termed adjust-in-motion.

An advantage of the shutheight mechanism of the present invention, in accordance with one form thereof, is that the injected oil within the chamber helps control punching and snapthrough loads through the bolster adjustment mechanism. This levels the dynamic loads over the entire adjustment mechanism thereby reducing part failure rates caused by unequal impulse forces.

Another advantage of the shutheight mechanism of the present invention is that the trapped oil beneath the adjustment screw helps reduce punch penetration resulting in a dynamically stiffer press die set thereby correspondingly increasing die life. By more accurately controlling shutheight, accidental impacts between the dies are reduced.

Yet another advantage of the shutheight mechanism is a thread clearance takeup arrangement whereby the free thread clearance is eliminated by action of the two nuts of the locknut assembly separated by hydraulic pressure. The pressure between the two parts may be varied. This variable pressure allows adjustment of shutheight. The threads are not normally forced together sufficiently to be clamped or locked; however, it could be pressurized sufficiently to lock the adjustment screw. The elimination of free thread clearance allows for accurate shutheight adjustment.

A further advantage of the shutheight adjustment mechanism of the present invention is that the part clearances filled with oil eliminate undamped free movement between parts, helping to resist changes in dynamic shutheight. This resistance to changes in shutheight permit the press to create workpieces with smaller tolerances.

The invention, in one form thereof, provides a press, having a frame structure with a crown and a bed, in which a slide is guided by the frame structure for rectilinear reciprocating movement in opposed relation to the bed. A driving means is attached to the frame structure for reciprocating the slide, and a bolster assembly is mounted to the bed. A shutheight adjustment mechanism arranged for adjustment in motion includes a housing connected to either the bolster or the press frame to adjust the shutheight between the slide and bolster. The adjustment mechanism includes an adjustment screw attached to the housing with a fluid pressurized chamber between the housing and the screw to preload the screw toward the bolster. An adjustment nut is threaded onto the adjustment screw and attached to the other of either the bolster or press frame, so that relative motion of the nut and screw displaces the bolster relative to the slide in the rectilinear direction of slide movement. The adjustment nut includes a separate clearance takeup nut attached to the adjustment screw. A clearance takeup means for either axially separating or drawing together the adjustment screw and the takeup nut is included so that the takeup nut interferes with the adjustment screw and that clearance space between the adjustment screw and adjustment nut is substantially eliminated. This elimination of clearance space reduces shutheight variations between the slide and the bolster during press operation.

Additionally, a bearing is disposed within the fluid pressurized chamber and about the screw to reduce radial movement of the adjustment screw.

In another form of the invention, a press having a frame, slide and bolster includes a shutheight adjustment mechanism arranged for adjustment in motion in which the mechanism includes a housing connected to one of the frame or bolster with a threaded adjustment screw attached to the housing. An adjustment nut is threadedly connected to the screw and fixedly attached to the other of the frame or bolster whereby relative rotation of the nut and the screw displaces the bolster relative to the slide in the rectilinear direction of slide movement. The adjustment mechanism has a stiffening means to increase the stiffness and reduce unintended movement of the adjustment mechanism. The stiffening means includes a takeup nut threadedly attached to the adjustment screw and adjacent the adjustment nut. A first fluid pressurized chamber is located between the takeup nut and adjustment nut such that the fluid within this first chamber forces apart the takeup nut and the adjustment nut in opposite axial directions causing threads on the takeup nut and the adjustment nut to directly contact opposite facing threads of the adjustment screw. A second fluid pressurized chamber is disposed between the housing and the adjustment screw such that the fluid axially biases the adjustment screw towards the bolster to preload the adjustment screw in the direction of the bolster so that shutheight variation between the slide and the bolster are reduced during press operation.

In another form of the invention, the shutheight adjustment mechanism attached to the press includes a bearing plate located within the housing. The bearing plate includes a first side and a second side, each normal to the axis of reciprocation of the slide. The adjustment screw extends through the plate and extends beyond both the first and second sides. A bearing is located between the adjustment screw and the second side with this bearing being adjacent the second side. The adjustment screw includes a radially extending flange engaging the bearing. In this form of the invention, a fluid chamber contains a fluid at high pressure between the first side and the adjustment screw, so that fluid axially loads the adjustment screw away from the first side so that the bearing is loaded against the second side by the adjustment screw. This causes the adjustment screw to be preloaded relative to the housing thereby reducing shutheight variations.

In another form of the invention, a press includes a frame structure having a crown, bed and slide. The slide is guided by the frame structure for reciprocating movement in opposed relationship to the bed. A drive means is attached to the frame structure for reciprocating the slide. A bolster assembly is mounted to the bed. A shutheight adjustment mechanism arranged for adjustment in motion has a housing and is attached on one of the press frame or bolster to adjust the shutheight between the slide and the bolster. The adjustment mechanism further includes a threaded adjustment screw rotatably attached to the housing and an adjustment nut threadedly attached to the adjustment screw and fixedly attached to the other of the press frame or bolster. A biasing means is included for biasing the adjustment screw towards the bolster. This biasing means is disposed in the housing and preloads the adjustment screw. A means for reducing the clearance space between the rotatable adjustment screw and adjustment nut is included comprising a takeup nut disposed on the adjustment screw and axially biased away from the adjustment nut so that the takeup nut and the adjustment nut directly contact opposite facing threads on the adjustment screw.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
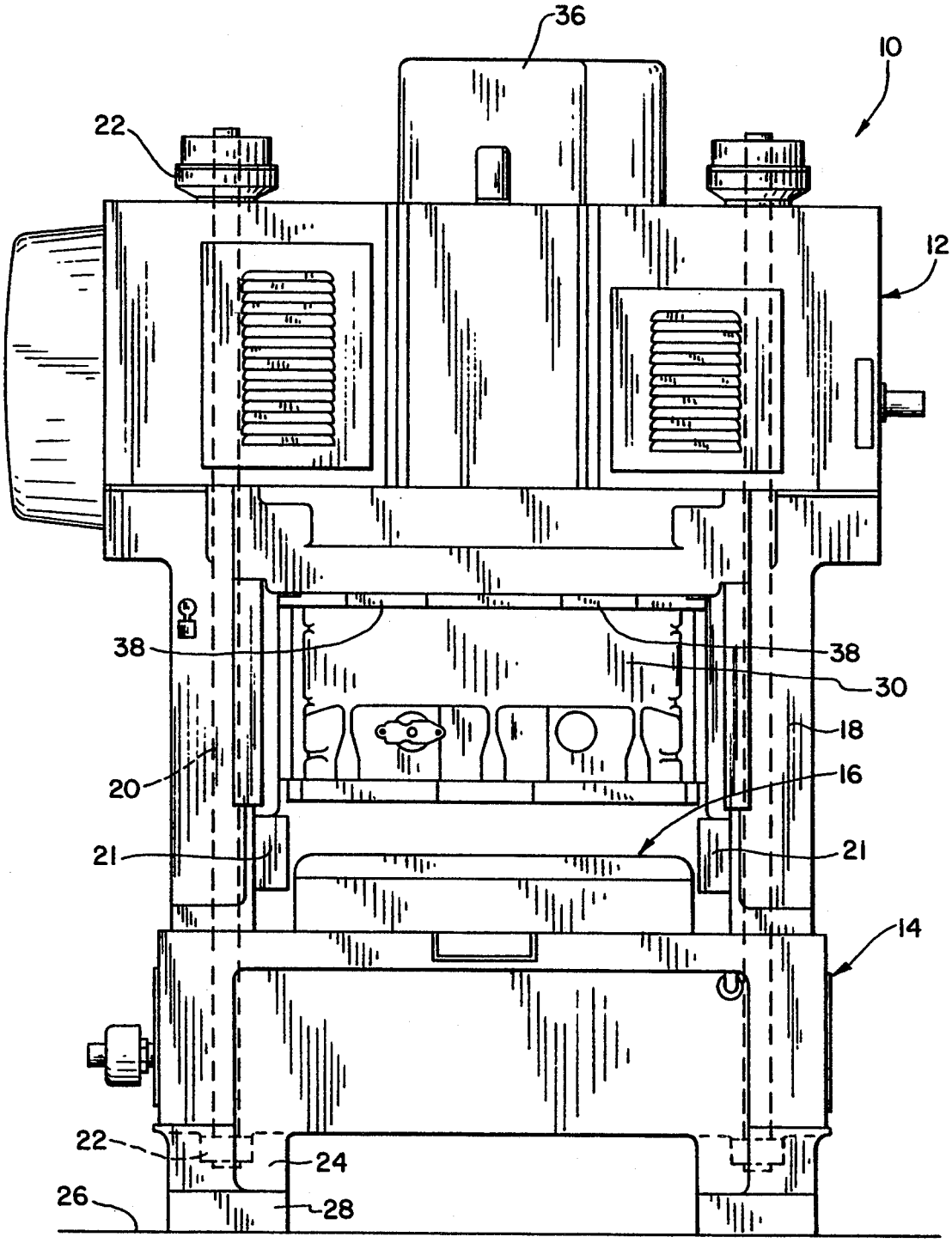
FIG. 1 is a front elevational view of a mechanical press incorporating the shutheight adjustment mechanism of the present invention.

Referring now to FIG. 1, mechanical press 10 comprises a crown portion 12, a bed portion 14 having a bolster assembly 16 connected thereto and uprights 18 connecting crown portion 12 with bed portion 14. Uprights 18 are connected to or integral with the underside of crown 12 and the upper side of bed 14. Tie rods 20 extend through crown 12, uprights 18 and bed portion 14 and are attached at each end with tie rod nuts 22. Leg members 24 are formed as an extension of bed 14 and are generally mounted on the shop floor 26 by means of shock absorbing pads 28.

Press shutheight is controlled in a known manner by first measuring the shutheight between slide 30 and bolster 16 by a shutheight measuring means 21 such as a limit switch, an accelerometer or a non-contacting optical or electrical sensing means as is known in the art. The shutheight adjustment mechanism is then activated to change the measuring shutheight to a desired shutheight. The present invention is directed to improve current shutheight adjustment mechanisms thereby permitting more accurate shutheight adjustment while the press 10 is cycling.

The present invention comprises preloading the shutheight adjustment assembly by injecting pressurized fluid between the adjustment screw and its housing. Also protection along threaded members and parts that make contact during press cycling is achieved by using a two part lock nut assembly that reduces clearances between the adjustment screw and other parts. Although oil is the preferred fluid used in the shutheight adjustment mechanism, other hydraulic fluids may be used.

Creation of an oil squeeze film layer is caused by injecting lubrication oil into the adjustment mechanism and then trapping this oil beneath the adjustment screw so that the adjustment screw is preloaded in the direction of press closure.

The injection means of the present invention includes a pump 164 to inject oil into clearance spaces 132, 138 or 140. Pump 164 is operably connected to an oil supply (not shown).

Figure 2:
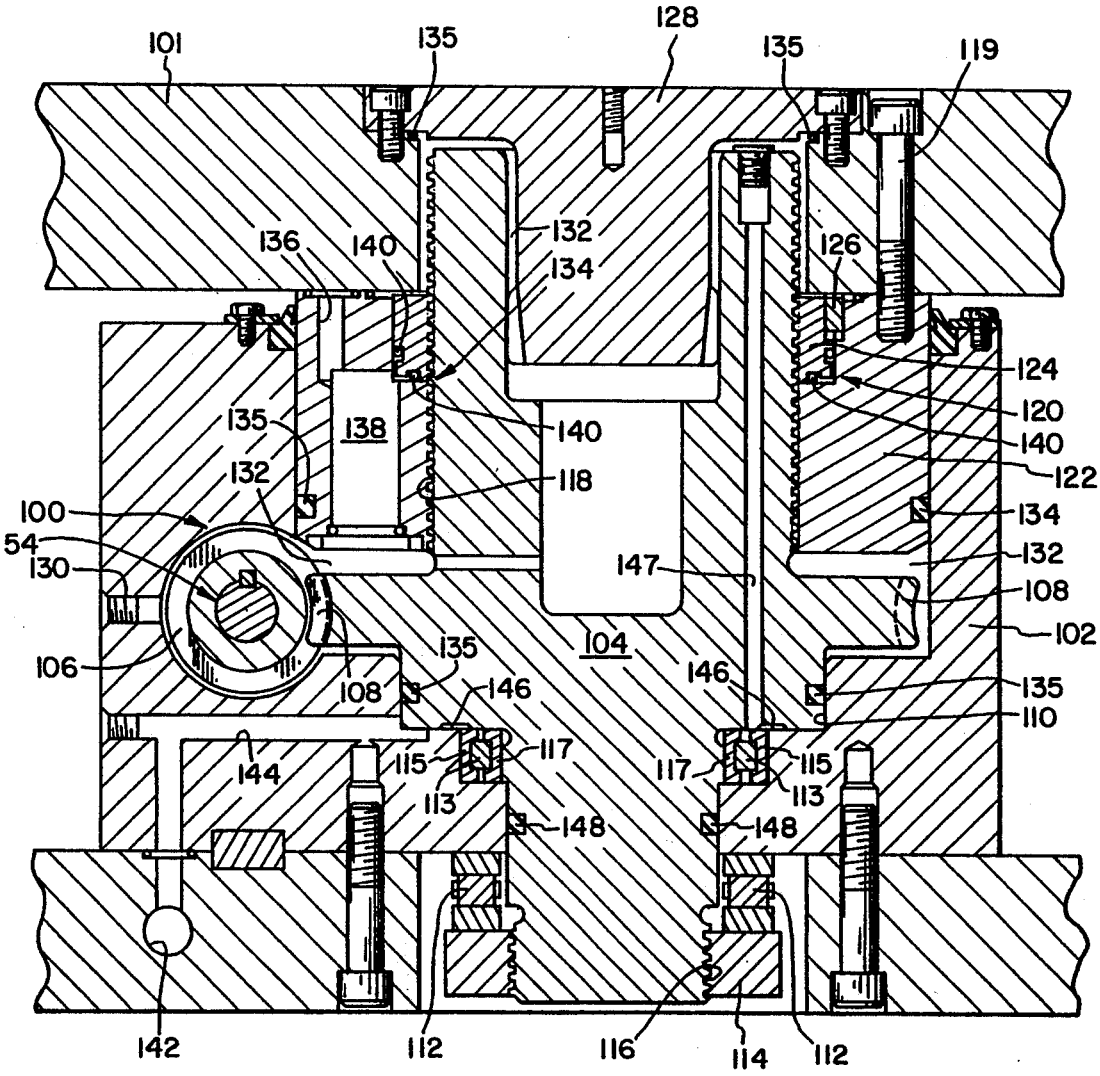
FIG. 2 is an enlarged fragmentary sectional view of an adjustment mechanism for a bolster incorporating the present invention.
Figure 3:
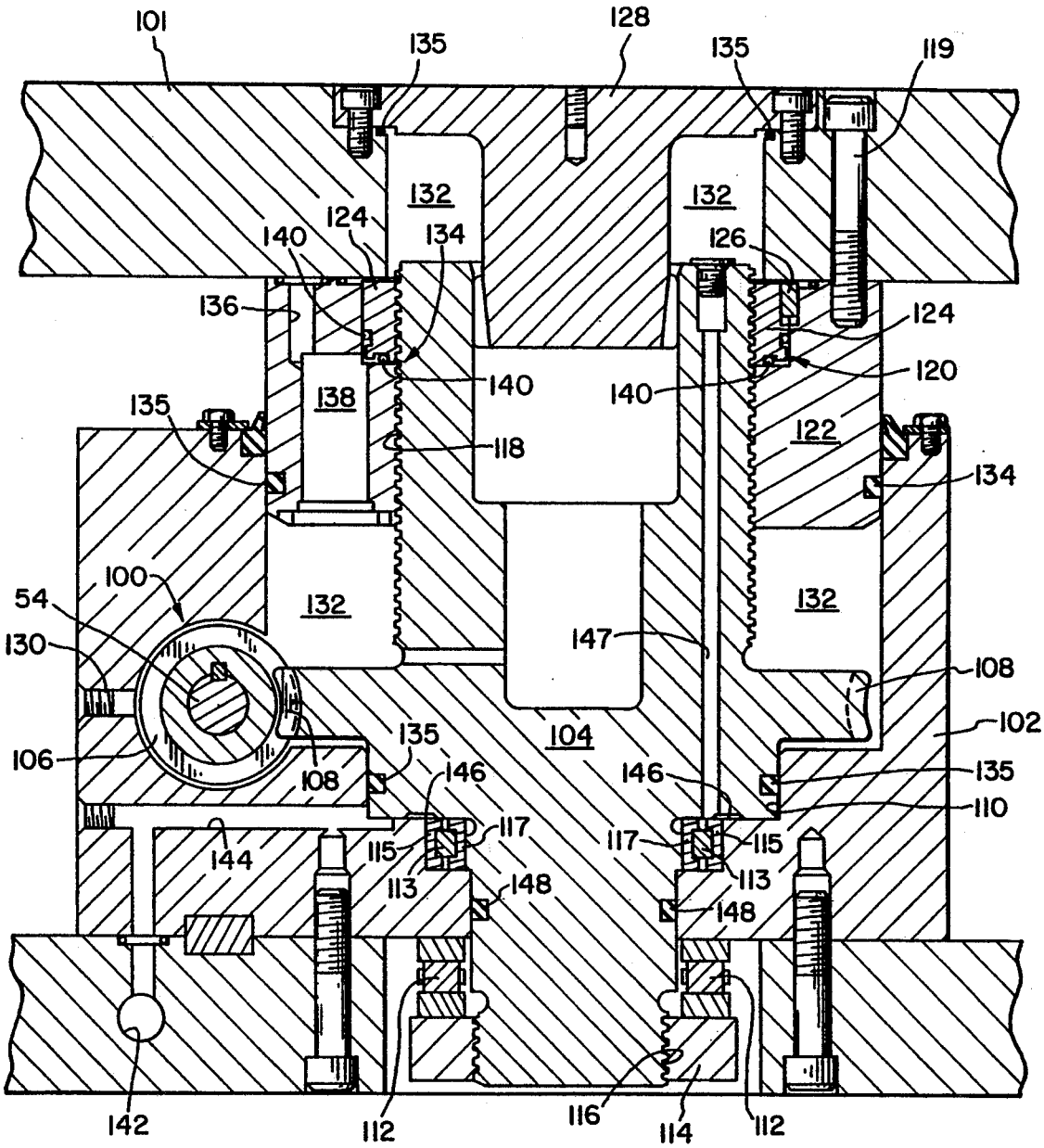
FIG. 3 is an enlarged fragmentary sectional view of the bolster adjustment mechanism of FIG. 2 shown in a different shutheight position.

An embodiment of the shutheight adjustment mechanism utilizing concepts of the present invention is shown in FIGS. 2 and 3. Although only one adjustment mechanism 100 is shown in FIG. 2, normally a press 10 would contain a plurality of such shutheight adjustment mechanisms 100.

FIG. 2 shows a bolster shutheight adjustment mechanism 100 attached to bolster housing 102 and a bolster top plate 101 having a guide plate 128. This embodiment operates by having the adjustment screw rotate instead of the adjustment nut. Shutheight adjustment is caused by rotation of adjustment screw 104 rotating within housing 102. Rotation of screw 104 will cause bolster top plate 101 to move relative slide 30 (FIG. 3).

Adjustment screw 104 is caused to rotate in a known manner by a worm 106 engaging gear teeth 108 on screw 104. Adjustment screw 104 is located within a chamber 110 within housing 102 upon thrust bearings 112. Thrust bearings are connected to a retainer 114 that rotates about a lower threaded portion 116 of adjustment screw 104. Between housing 102 and screw 104 is also a roller bearing 113 having an outer race 115 and an inner race 117 to reduce rotational friction. At this location, screw 104 passes through a bearing plate portion of housing 102. Adjustment screw 104 includes an upper threaded portion 118 that threadably interfits with a lock nut assembly 120.

Lock nut assembly 120 attached to bolster top plate 101 by bolts 119 comprises an adjustment nut 122, a lock nut portion 124 and a key 126. Lock nut assembly 120 acts as a thread clearance takeup device (or a means to reduce clearance space between the screw 104 and adjustment nut 122). In order for adjustment screw 104 to turn within adjustment nut 122, a certain amount of thread clearance is required. However, as has been discussed before, free clearance will show up as a looseness in the support for the adjustable bolster top plate 101 and interfit guide plate 128. Adjustment nut 122 normally rests on adjustment screw threads 118. During press operation, bolster rebound or other upward forces will cause top plate 101 to move vertically away from adjustment screw 104.

To fill the clearances, oil or other fluid is flooded around worm 106 through oil inlet 130. Oil is pumped through and fills the clearance space 132 between worm 106 and bolster housing 102, and the spaces between the housing 102 and adjustment screw 104. Further, this oil is caused to flood upper threaded portion 118 of adjustment screw 104 and under interfit guide plate 128. This oil allows an oil squeeze film to be produced between the upper threads 118 of screw 104 and the threads 134 of lock nut assembly 120.

Figure 4:
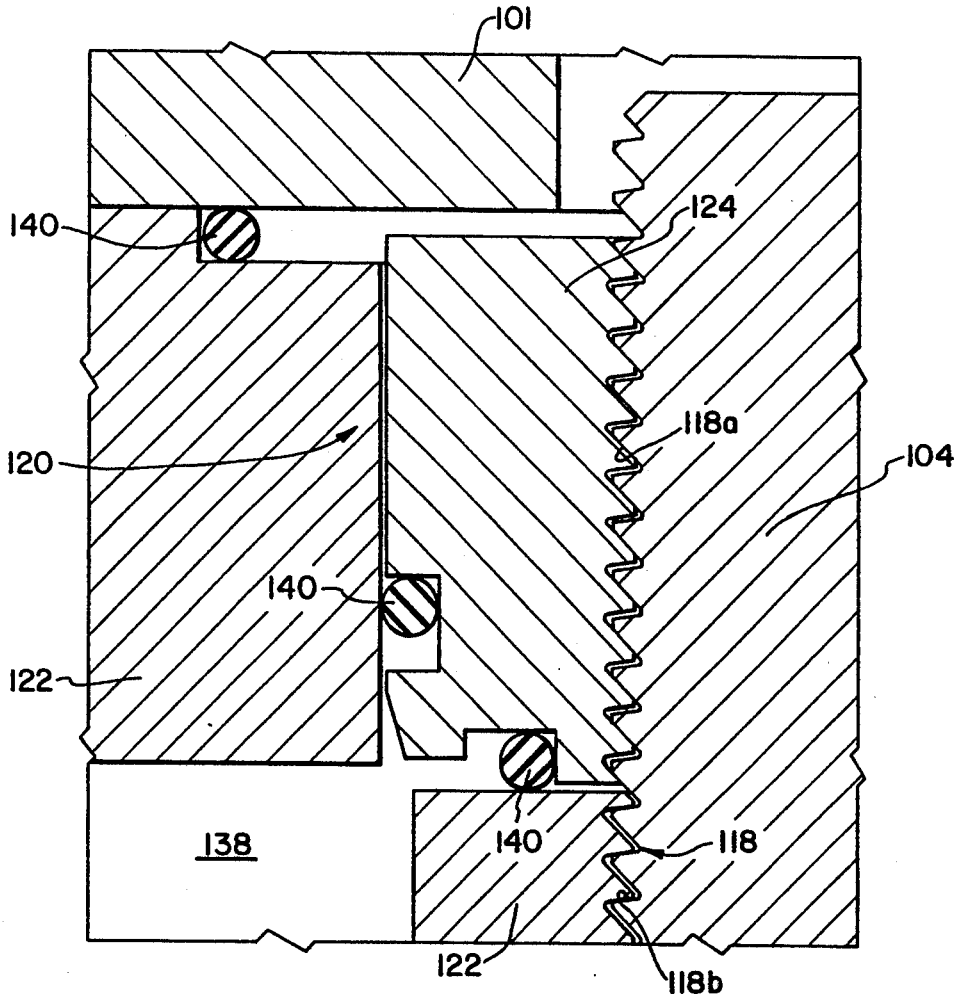
FIG. 4 is an enlarged fragmentary sectional view of the two part lock nut assembly of the present invention.
Figure 5:
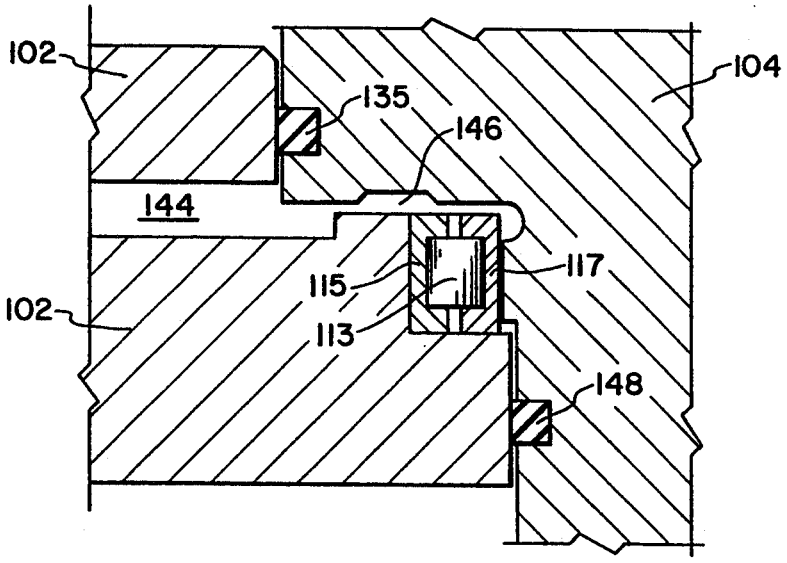
FIG. 5 is an enlarged fragmentary sectional view of the preload chamber of the present invention.

To prevent bolster plate 101 from bouncing upward according to the invention, two mechanisms are used. The first mechanism included to reduce bolster bounce back is lock nut assembly 120 including a thread clearance takeup mechanism such as lock nut or takeup nut 124. As shown in FIG. 4, adjustment nut 122 includes a takeup pressure inlet 136 to permit introduction of lubrication oil into a chamber 138 within adjustment nut 122 and between takeup nut 124 and adjustment nut 122. Oil within oil chamber 138 is injected between the space between takeup nut 124 and adjustment nut 122 thereby separating the aforementioned nuts. When the lubrication oil under sufficient pressure is introduced between the adjustment nut 122 and takeup nut 124, the nuts are forced apart and bear against to rest on opposing thread flanks of upper threaded portion 118, thereby eliminating free clearance. As can be seen from FIG. 4, lock nut assembly 120 permits takeup nut 124 to be forced against the underside flanks **118*a* of adjustment screw 104, i.e., threaded portion 118, while adjustment nut 122 is forced into contact with the top flanks 118*b* of adjustment screw 104. The pressurized oil within chamber 138 causes metal to metal contact between adjustment screw 104 and both adjustment nut 122 and takeup nut 124. Takeup nut 124 is prevented from rotating by key 126. Oil chamber 138 along with the space between takeup nut 124 and adjustment nut 122 are sealed by a plurality of seals 140**.

A clearance space 132, between the parts as shown in FIGS. 2 and 3, is sealed by a plurality of seals 135 on possible leak paths past adjustment nut 122, guide plate 128 and bolster housing 102.

In the illustrated embodiment, a second mechanism, a separate preload pressure system, is used to lift adjustment screw 104 and preload adjustment mechanism 100. Oil or other fluid, at relatively high pressure, enters an oil inlet 142 as shown in FIG. 2. Oil flows through a conduit 144 into a clearance space 146 between bolster housing 102 and adjustment screw 104. The oil is thereby trapped between seals 135 and seals 148. A passageway 147 is included through adjustment nut 104 to bleed air from clearance space 146.

The force of high pressure oil within clearance space 146, between adjustment screw 104 and bolster housing 102, urges adjustment screw 104 upward preloading thrust rotor bearing 112 between retainer 114 and housing 102. This oil further provides a thin film of oil to support the stamping forces of press 10. High pressure oil (at approximately 1500 psi) within clearance space 146 also pressurizes roller bearing 113. The oil reduces the torque necessary for rotation of adjustment screw 104 and subsequently shutheight adjustments.

The force of oil pressure through conduit 144 and clearance space 146 preloads adjustment screw 104 thereby allowing adjustment screw 104 to become stiff and reducing any change in vertical position of screw 104 and subsequent shutheight changes. Forces from the die (not shown) associated with bolster plate 101 are transferred to bolster housing 102 through the oil within clearance space 146.

In operation, vertical bolster top plate 101 position is determined by a shutheight measuring means such as shutheight measuring means 21. If a change in shutheight is necessary, a drive means such as a motor (not shown) will cause worm 106 to rotate adjustment screw 104 in a known way. After adjustment screw 104 has been rotated the proper amount to raise bolster plate 101 relative bolster housing 102, worm 106 is prevented from rotating. FIG. 3 shows another adjustment position of the device.

The present invention, as shown in the previous embodiment, is not limited to shutheight adjustment mechanisms located within the slide or bolster portions of a press. Depending upon the size of press 10 and the required tonnage, different locations for shutheight adjustment are possible. Although housing 102 is shown connected to the press frame while adjustment nut 122 is connected to bolster 101, they may be equivalently mechanically inverted.

The feedback means for automatically controlling the shutheight will be discussed in relation to FIG. 6. However, it is understood and appreciated that alternative control arrangements may be utilized to control the set shutheight.

Figure 6:
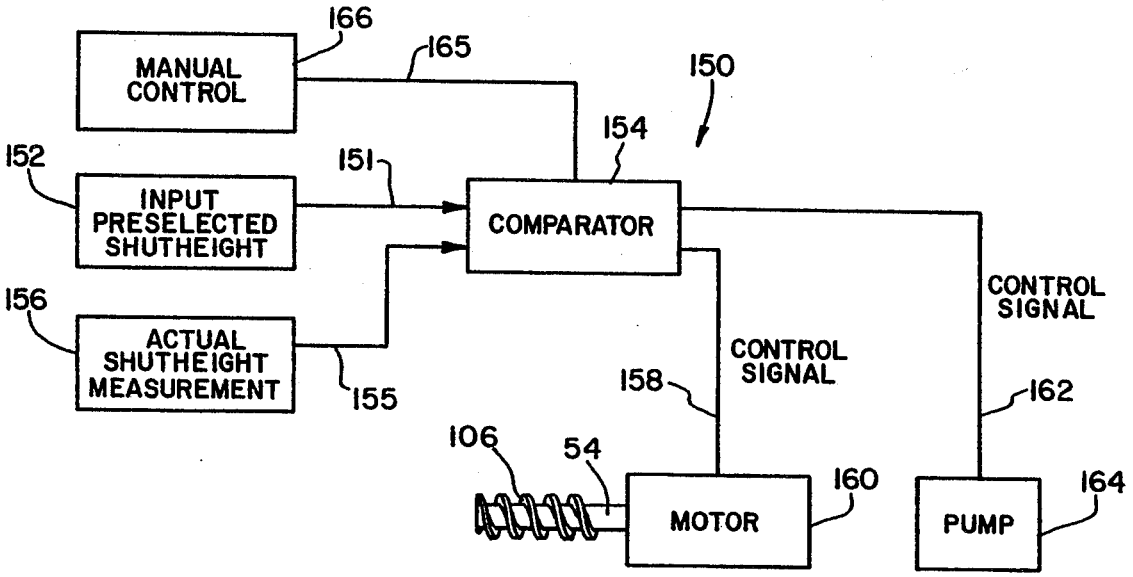
FIG. 6 is an exemplary diagrammatic arrangement of an automatic feedback means usable with the present invention.

Automatic control of shutheight is maintained by a control or feedback means 150 as shown in FIG. 6. Prior to operation, the press operator inputs a preselected shutheight 152 through line 151 into the comparator 154. Feedback means 150 including a comparator 154 may comprise a microprocessor as known in the art. Comparator 154 receives input signals and provides output or control signals as a function of its inputs.

Shutheight measuring means 21 of FIG. 1 transmits an actual shutheight measurement 156 during press operation. Comparator 154 compares the difference between the preselected shutheight 152 and the actual shutheight 156 and forms a control signal on line 158 to control motor 160 and another control signal on line 162 to an oil flow and/or pressurizing means such as oil pump 164. Pump 164 connects to clearance space 132 or oil inlet 142 to variably pressurize the oil therein. The results of the comparison between preselected shutheight 152 and the actual shutheight measurement 156 causes comparator 154 to vary the control signal on line 158 to control motor 160 to rotate control motor 160 forward or reverse. As shown in FIG. 6, control motor 160 is connected to rotatable shaft 54 and worm 106 to cause rotation of adjustment screw 104. As shown in FIG. 6, comparator 154 may be overridden via a manual control circuit 166 along a line 165 for direct operator control of control motor 160 and pump 164.

Comparator 154, based on its inputs, may vary control signal on line 162 to pump 164 to vary the volume and pressure of oil pumped by pump 164. In this fashion, oil within clearance space 146 takeup pressure inlet 136, and oil inlet 130 may be altered in pressure or flow during press operation and/or during shutheight adjustment. If necessary, the comparator may control more than one pump 164 as in the embodiment shown in FIGS. 2 and 3, wherein more than one oil pressure and flow system is needed at the same time, each running at different pressures which may be adjusted in flow and pressure during press operation and/or when the shutheight adjustment mechanism actuates.

Alternatively, instead of the comparator 154 being in the form of a microprocessor, a programmable logic controller may be utilized as is known in the art.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press comprising:

a frame structure with a crown and a bed;

a slide guided by the frame structure for rectilinear reciprocating movement in opposed relation to said bed;

a drive means attached to said frame structure for reciprocating said slide;

a bolster assembly mounted to said bed; and a shutheight adjustment mechanism having a housing, said shutheight adjustment mechanism arranged for adjustment-in-motion, said housing connected said press frame to adjust the shutheight between said slide and said bolster, said adjustment mechanism comprising an adjustment screw attached to said housing and a fluid pressurized chamber between said housing and said screw to preload said screw toward said bolster, said adjustment mechanism further including an adjustment nut threaded on said screw and attached to said bolster so that relative rotation of said nut and said screw displaces said bolster relative said slide in the rectilinear direction of said slide movement, said adjustment nut including a separate clearance takeup nut attached to said adjustment screw, a clearance takeup means for one of axially separating or drawing together said adjustment nut and said takeup nut, said takeup nut interfering with said adjustment screw such that clearance space between said adjustment screw and said adjustment nut is substantially eliminated whereby shutheight variations are reduced between said slide and said bolster during press operation.

2. The press of claim 1 in which said adjustment mechanism includes a bearing disposed within said fluid pressurized chamber and about said screw to reduce radial movement of said adjustment screw.

3. The press of claim 1 in which said clearance takeup means comprises a sealed chamber pressurized with a fluid to axially separate said adjustment nut and said takeup nut into contact with opposite facing thread surfaces of said adjustment screw thereby reducing thread clearance and press rebound.

4. The press of claim 3 in which said pressurized fluid in said sealed chamber causes metal to metal contact between said adjustment screw and both said adjustment nut and said takeup nut.

5. The press of claim 1 in which said adjustment nut and said takeup nut are keyed together to prevent relative rotation.

6. A press comprising:

a frame structure with a crown and a bed;

a slide guided by the frame structure for rectilinear reciprocating movement in opposed relation to said bed;

a drive means attached to said frame structure for reciprocating said slide;

a bolster assembly mounted to said bed;

a shutheight adjustment mechanism arranged for adjustment-in-motion, said mechanism including a housing connected to said frame, a threaded adjustment screw attached to said housing, an adjustment nut threadedly connected to said screw and fixedly attached to said bolster, whereby relative rotation of said nut and said screw displaces said bolster relative said slide in the rectilinear direction of said slide movement, said adjustment mechanism having a stiffening means to increase the stiffness and reduce unintended movement of said adjustment mechanism, said stiffening means comprising:

a takeup nut threadedly attached to said adjustment screw and adjacent said adjustment nut;

a first fluid pressurized chamber between said takeup nut and said adjustment nut such that the fluid within said first chamber forces apart said takeup nut and said adjustment nut in opposite axial directions causing threads on said takeup nut and said adjustment nut to directly contact opposite facing threads of said adjustment screw; and a second fluid pressurized chamber disposed between said housing and said adjustment screw such that the fluid axially bias said adjustment screw toward said bolster to preload said adjustment screw in the direction of said bolster whereby shutheight variations between said slide and said bolster are reduced during press operation.

7. The press of claim 6 in which said fluid within said first pressurized chamber and said second pressurized chamber comprises lubrication oil.

8. The press of claim 6 in which said adjustment nut and said takeup nut are keyed together to prevent relative rotation.

9. The press of claim 6 in which threaded portions of said adjustment screw which contact the threads of said adjustment nut contact are flooded with oil.

10. The press of claim 9 in which said adjustment nut and said takeup nut together form said first fluid pressurized chamber.

11. The press of claim 10 in which said pressurized fluid in said first chamber causes metal to metal contact between the threads of said adjustment screw and both said adjustment nut and said takeup nut.

12. A press comprising:

a frame structure with a crown and a bed;

a slide guided by the frame structure for reciprocating movement in opposed relation to said bed;

a drive means attached to said frame structure for reciprocating said slide;

a bolster assembly mounted to said bed; and a shutheight adjustment mechanism having a housing, said shutheight adjustment mechanism arranged for adjustment-in-motion and said housing attached on said press frame to adjust the shutheight between said slide and said bolster, said adjustment mechanism further including a threaded adjustment screw rotatably attached to said housing;

an adjustment nut threadedly attached to said adjustment screw and fixedly attached to said bolster;

a takeup nut disposed about said adjustment screw and adjacent said adjustment nut;

a first fluid filled chamber located between and axially separating said adjustment nut and said takeup nut to cause clearance space between said adjustment nut and said adjustment screw to be eliminated;

a bearing plate located within and attached to said housing, said bearing plate having a first side and a second side each normal to the axis of reciprocation of said slide, said adjustment screw extending through said plate and extending beyond both said first and said second sides;

a first bearing between said adjustment screw and said second side, said first bearing being adjacent said second side, said adjustment screw having a radially extending flange engaging said bearing; and a fluid chamber containing fluid at high pressure between said first side and said adjustment screw, said fluid axially loading said adjustment screw away from said first side, whereby said bearing is loaded against said second side by said adjustment screw so that said adjustment screw is preloaded relative to said housing thereby reducing shutheight variation during press operation.

13. The mechanism of claim 12 in which said fluid chamber is sealed by seals disposed within said adjustment screw.

14. The mechanism of claim 13 in which a second bearing is disposed within said chamber between said adjustment screw and said bearing plate whereby the torque required for rotation of said adjustment screw is reduced.

15. A press comprising:

a frame structure with a crown and a bed;

a slide guided by the frame structure for reciprocating movement is opposed relation to said bed;

a drive means attached to said frame structure for reciprocating said slide;

a bolster assembly mounted to said bed; and a shutheight adjustment mechanism having a housing, said shutheight adjustment mechanism arranged for adjustment-in-motion and said housing attached on said press frame to adjust the shutheight between said slide and said bolster, said adjustment mechanism further including:

a threaded adjustment screw rotatably attached to said housing;

an adjustment nut threadedly attached to said adjustment screw and fixedly attached to said bolster;

biasing means for biasing said adjustment screw toward said bolster, said biasing means disposed within said housing, whereby said adjustment screw is preloaded; and means for reducing the clearance space between said rotatable adjustment screw and said adjustment nut whereby shutheight variations are reduced between said slide and said bolster during press operation.

16. The press of claim 15 in which said biasing means includes a fluid pressurized chamber located between said adjustment screw and said housing so that the fluid forces said screw toward said bolster.

17. The press of claim 15 in which said means for reducing clearance space includes an takeup nut disposed on said adjustment screw and axially biased away from said adjustment nut so that said takeup nut and said adjustment nut directly contact opposite facing threads of said adjustment screw.

18. The press of claim 17 in which said takeup nut is axially biased away from said adjustment nut by a second fluid filled chamber.

* * * * *

UNITED STATES PATENT AND TRADEMARK OFFICE

CERTIFICATE OF CORRECTION

PATENT NO. : 5,345,861

DATED : September 13, 1994

INVENTOR(S) : William C. Brewer, et al

It is certified that error appears in the above-identified patent and that said Letters Patent is hereby corrected as shown below:

Claim 1, column 8, line 43, after "connected" insert --to--.

Signed and Sealed this

Thirteenth Day of December, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,345,861

DATED : September 13, 1994

INVENTOR(S) : WILLIAM C. BREWER ET AL

It is certified that error appears in the above-indentified patent and that said Letters Patent is hereby corrected as shown below:

On the title page of the patent in section [73] Assignee, change "Minater" to --MINSTER--.

Signed and Sealed this

Eleventh Day of April, 1995

Bruce Lehman

*Attest:*

BRUCE LEHMAN

*Attesting Officer*

*Commissioner of Patents and Trademarks*